US005841254A

United States Patent [19]

Balch et al.

[11] Patent Number: 5,841,254

[45] Date of Patent: Nov. 24, 1998

[54] TORQUE MAXIMIZATION AND VIBRATION CONTROL FOR AC LOCOMOTIVES

[75] Inventors: Edgar Thomas Balch; Ajith Kuttannair Kumar, both of Erie; Luzern Arthur Richter, North East, all of Pa.; Sean Erin Gleason, Indianapolis, Ind.

[73] Assignee: General Electric Company, Erie, Pa.

[21] Appl. No.: 890,220

[22] Filed: Jul. 9, 1997

[51] Int. Cl.[6] ..... B60K 1/00; B61C 15/08

[52] U.S. Cl. ..... 318/430; 318/52; 318/71; 180/197

[58] Field of Search ..... 318/40–89, 139, 318/430–449; 180/197, 65.1, 65.2, 65.8, 65.4; 303/151, 20, 100, 111, 112; 388/814; 364/424.02, 801, 424.08; 192/0.832, 0.076, 103 F; 73/650

[56] References Cited

U.S. PATENT DOCUMENTS

| | | | |
|---|---|---|---|
| 4,243,927 | 1/1981 | D'Atre . | |
| 4,267,734 | 5/1981 | Shima et al. | 73/650 |
| 4,276,782 | 7/1981 | Shima et al. | 73/650 |
| 4,427,930 | 1/1984 | Berman et al. | 318/301 |
| 4,701,682 | 10/1987 | Hirotsu et al. | 318/52 |
| 4,896,090 | 1/1990 | Balch et al. | 318/52 |
| 5,064,036 | 11/1991 | Schneider | 192/0.032 |
| 5,480,220 | 1/1996 | Kumar | 303/151 |

*Primary Examiner*—Paul Ip
*Attorney, Agent, or Firm*—Jill M. Breedlove; Douglas E. Stoner

[57] ABSTRACT

A traction control system for an ac locomotive optimizes traction performance by separately controlling the allowable creep level of each individual axle and by minimizing torsional vibration per axle. The traction control system includes a torque maximizer and a torsional vibration detector. The torque maximizer measures traction system performance levels and determines the desired torque maximizer state for maximizing traction performance of each individual axle. The torsional vibration detector digitally processes estimated torque feedback of each traction motor in order to detect an unacceptable level of torsional vibration. The outputs of the torque maximizer and the torsional vibration detector are provided to a creep modulator which processes these inputs in order to control the operating creep level of each locomotive axle. As a result, traction performance is improved while minimizing torsional vibration and operating noise levels due to wheel/rail squeal.

12 Claims, 4 Drawing Sheets

TORQUE MAXIMIZATION AND VIBRATION CONTROL FOR AC LOCOMOTIVES

BACKGROUND OF THE INVENTION

The present invention relates generally to traction control systems for ac locomotives and, more particularly, to such a system which maximizes torque and minimizes torsional vibration per axle.

In a modern conventional diesel-electric locomotive, a thermal prime mover (typically a 16-cylinder turbocharged diesel engine) is used to drive an electrical transmission comprising a synchronous generator that supplies electric current to a plurality of electric traction motors whose rotors are coupled through speed-reducing gearing to the respective axle-wheel sets of the locomotive. The generator typically comprises a main 3-phase traction alternator, the rotor of which is mechanically coupled to the output shaft of the engine. When excitation current is supplied to field windings on the rotating rotor, alternating voltages are generated in the 3-phase armature windings on the stator of the alternator. These voltages are rectified and applied via a DC link to one or more inverters where the DC voltage is inverted to AC and applied to AC traction motors.

In normal motoring operation, the propulsion system of a diesel-electric locomotive is so controlled as to establish a balanced steady-state condition wherein the engine-driven alternator produces, for each discrete position of a throttle handle, a substantially constant, optimum amount of electrical power for the traction motors. In practice, suitable means are provided for overriding normal operation of the propulsion controls and reducing engine load in response to certain abnormal conditions, such as loss of wheel adhesion or a load exceeding the power capability of the engine at whatever engine speed the throttle is commanding or a fault condition such as a ground fault in the electrical propulsion system.

As is generally known, the 3-phase synchronous generator in a locomotive propulsion system develops an output voltage which is a function of its rotor shaft RPM and the DC voltage and current applied to its field windings. The 3-phase output is converted to DC power by a 3-phase full-wave bridge rectifier connected to the generator armature windings.

The DC power is coupled to a DC link and supplied to a plurality of parallel connected inverters. Each inverter comprises a plurality of electronically controllable switching devices, such as gate turn-off thyristors (GTO's), which can be gated in and out of conduction in a conventional manner so as to generate an AC output for powering AC electric traction motors coupled in driving relationship to respective axle-wheel sets of the locomotive.

One factor affecting traction performance is the creep level of the locomotive's traction control subsystem. Accordingly, in order to maximize traction performance, it is desirable to separately control the allowable creep level of each individual axle.

Another factor affecting traction performance is the level of torsional resonant vibration in the mechanical drive train, which comprises a locomotive axle and its associated two wheels, the motor to axle gearbox, the induction motor, and the induction motor drive. In particular, during operation in certain regions of the adhesion characteristic curve, the mechanical drive train may experience a net negative damping which produces severe vibration levels at the system's natural frequencies. (As is well-known, an adhesion characteristic curve graphically represents coefficient of friction versus percentage creep. At 0% creep, maximum damping on the mechanical system is represented. As the % creep level increases in the portion of the characteristic curve to the left of its peak, the damping effect on the mechanical system decreases to a value of zero at the peak. For values of % creep to the right of the peak, the damping provided to the mechanical system becomes a larger negative number.)

The natural frequencies of a system are a function of the drive train component materials and geometries which vary slightly over the life of a locomotive due to wear and tear. Dependent upon the magnitude and duration of the vibration periods, the drive train may be damaged. Accordingly, it is desirable to minimize torsional resonant vibration in order to maximize traction performance.

SUMMARY OF THE INVENTION

A traction control system for an ac locomotive optimizes traction performance by separately controlling the allowable creep level of each individual axle and by minimizing torsional vibration per axle. The traction control system comprises a torque maximizer and a torsional vibration detector. The torque maximizer measures traction system performance levels and determines the desired torque maximizer state for maximizing traction performance of each individual axle. The torsional vibration detector digitally processes estimated torque feedback of each traction motor in order to detect an unacceptable level of torsional vibration. The outputs of the torque maximizer and the torsional vibration detector are provided to a creep modulator which processes these inputs in order to control the operating creep level of each locomotive axle. As a result, traction performance is improved while minimizing torsional vibration and operating noise levels due to wheel/rail squeal.

BRIEF DESCRIPTION OF THE DRAWINGS

For a better understanding of the present invention, reference may be made to the following detailed description taken in conjunction with the accompanying drawings in which.

DETAILED DESCRIPTION OF THE INVENTION

Figure 1:
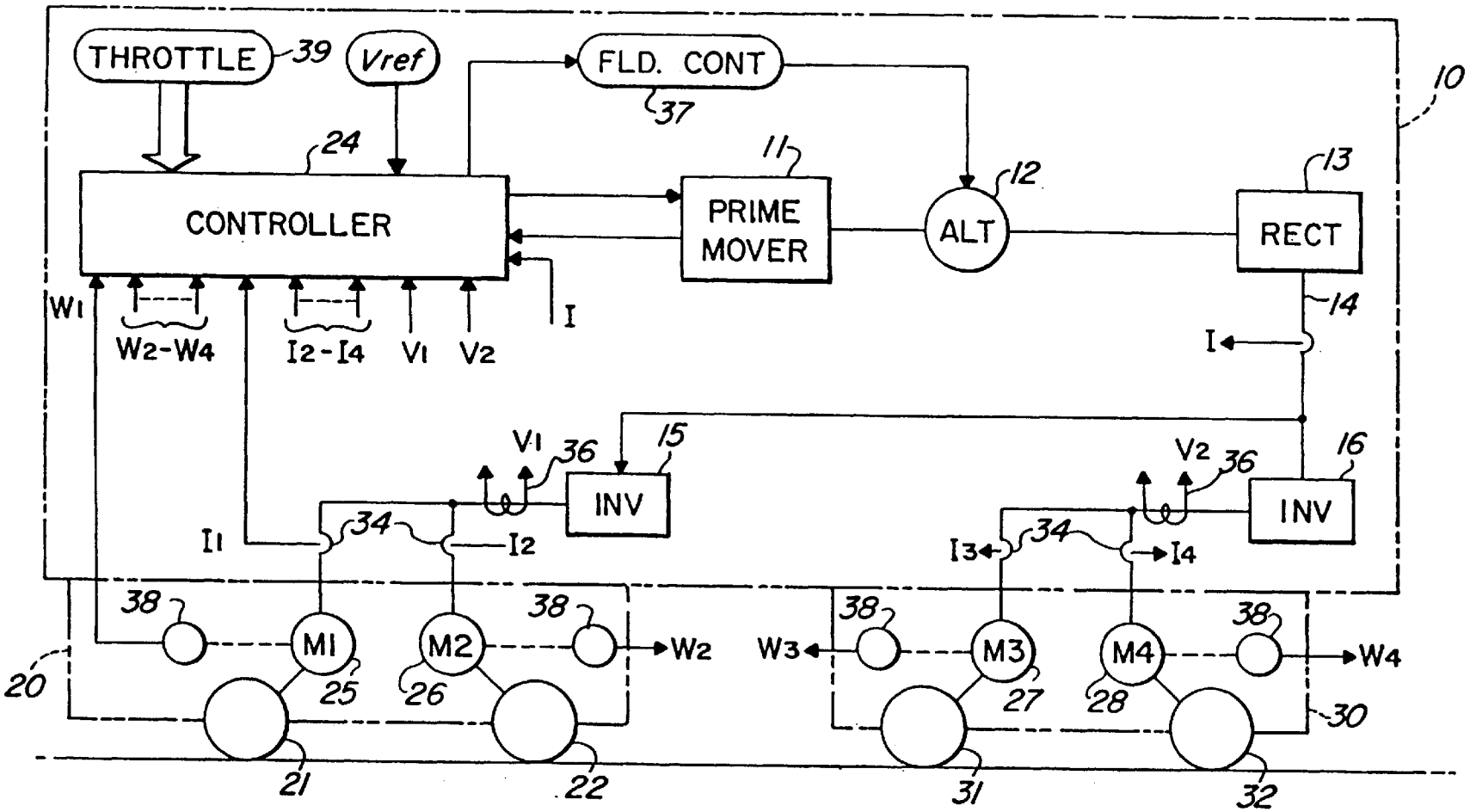
FIG. 1 is a simplified block diagram of the principal components of a propulsion system for a diesel-electric locomotive with which the present invention may be used.

The present invention may be utilized in various types of alternating current (AC) induction motor powered vehicles such as, for example, off-highway vehicles (earth moving machines), transit cars, and locomotives. For purposes of illustration, the invention is described herein as it may be applied to a locomotive. A propulsion system 10 of FIG. 1 includes a variable speed prime mover 11 mechanically coupled to a rotor of a dynamo electric machine 12 comprising a 3-phase alternating current (AC,) synchronous generator or alternator. The 3-phase voltages developed by alternator 12 are applied to AC input terminals of a conventional power rectifier bridge 13. The direct current (DC)

output of bridge 13 is coupled via a DC link 14 to a number of controlled inverters 15 and 16 which invert the DC power to AC power at a selectable variable frequency. The inverters 15 and 16 are conventional inverters employing high power gate turn-off devices (GTO's) which switch in and out of conduction in response to gating signals from a system controller 24 so as to invert the DC voltage on DC link 14 to controlled frequency AC voltage. The AC power is electrically coupled in energizing relationship to each of a plurality of adjustable speed AC traction motors 25–28. Prime mover 11, alternator 12, rectifier bridge 13, and inverters 15 and 16 are mounted on a platform of the traction vehicle 10, illustrated as a 4-axle diesel-electric locomotive. The platform is in turn supported on two trucks 20 and 30, the first truck 20 having two axle-wheel sets 21 and 22 and the second truck 30 having two axle-wheel sets 31 and 32.

Each of the traction motors 25–28 is hung on a separate axle and its rotor is mechanically coupled, via conventional gearing, in driving relationship to the associated axle-wheel set. In the illustrative embodiment, the two motors 25 and 26 are electrically coupled in parallel with one another and receive power from inverter 15 while motors 27 and 28 are coupled to inverter 16. However, in some instances, it may be desirable to provide an inverter for each motor or to couple additional motors to a single inverter. The invention is not limited to such 4-axle systems and is equally applicable to 6-axle locomotives with six inverters each connected for powering a respective one of six traction motors each connected to respective ones of the six axles. Suitable current transducers 34 and voltage transducers 36 are used to provide a family of current and voltage feedback signals which are respectively representative of the magnitudes of current and voltage in the motor stators. Speed sensors 38 are used to provide speed signals representative of the rotational speeds W1–W4 in revolutions per minute (RPM) of the motor shafts. These speed signals are readily converted to wheel speed in a well-known manner. For simplicity, only single lines have been indicated for power flow although it will be apparent that motors 25–28 are typically three phase motors so that each power line represents three lines in such applications.

The magnitude of output voltage and current supplied to rectifier bridge 13 is determined by the magnitude of excitation current supplied to the field windings of alternator 12 by field controller 37 which may be a conventional phase controlled rectifier circuit since the alternator field requires DC excitation. The excitation current is set in response to an operator demand (throttle 39) for vehicle speed by controller 24 which is in turn responsive to actual speed as represented by signals W1–W4. Controller 24 converts the throttle command to a corresponding torque request for use in controlling motors 25–28. Since AC motor torque is proportional to rotor current and air gap flux, these quantities may be monitored; or, more commonly, other quantities, such as applied voltage, stator current and motor RPM, may be used to reconstruct motor torque in controller 24. See, for example, U.S. Pat. No. 4,243,927.

In an electrical braking or retarding mode of operation, inertia of the moving vehicle is converted into electrical energy by utilizing the traction motors as generators. Motor voltage and current are controlled to set a desired braking effort.

Figure 2:
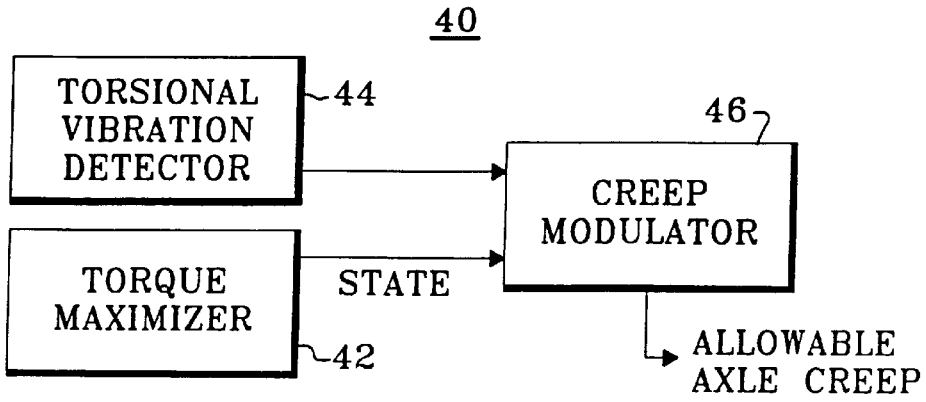
FIG. 2 is a simplified block diagram of a traction control system of the present invention.

In the apparatus of FIG. 2, the present invention is embodied in a traction control system 40. Traction control system 40 comprises a torque maximizer 42, a torsional vibration detector 44, and a creep modulator 46. Torque maximizer 42 measures traction system performance levels and determines the desired torque maximizer state for maximizing traction performance of each individual axle. Torsional vibration detector 44 digitally processes estimated torque feedback of each traction motor in order to detect an unacceptable level of torsional vibration. The outputs of the torque maximizer and the torsional vibration detector are provided to creep modulator 46 which processes these inputs in order to control the operating creep level of each locomotive axle.

Figure 3:
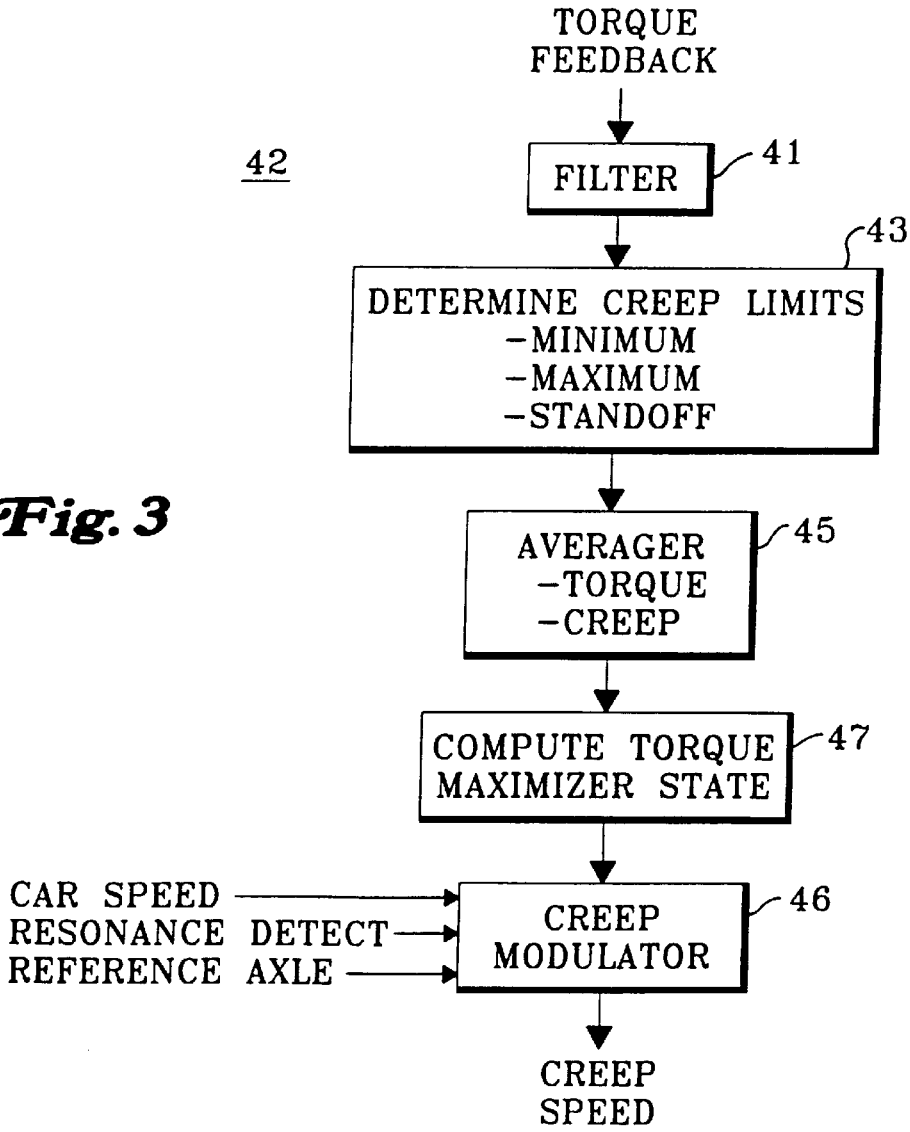
FIG. 3 is a block diagram illustrating one embodiment of a torque maximizer useful in the system of FIG. 2.

FIG. 3 illustrates an embodiment of torque maximizer 42. The function of the torque maximizer is to set the value of the torque maximizer state which, in turn, is used to control operation of the creep modulator. The possible torque maximizer states are as follows: (1) decrease the allowable creep level; (2) increase the allowable creep level; (3) maintain the present allowable creep level; and (4) modulate the allowable creep level toward a stand-off creep limit. The stand-off creep level is the allowable creep level that the adhesion control system will utilize after the system has not been in wheelslip or wheelslide control for a specified time period.

As illustrated in FIG. 3, the torque feedback is an input to the torque maximizer through a filter 41. The output of filter 41 is used to determine the creep levels in block 43. The stand-off creep limit is greater than the minimum allowable creep level and less than the maximum allowable creep level. The stand-off creep limit is determined as follows:

stand_off_creep=min. creep+k(max. creep−min. creep), where k=fixed constant (0→1).

Each of the states, or operating modes, is maintained at least for the duration of an averaging period. During the averaging period, the average value of torque level is computed in block 45. From the average values of torque obtained between adjacent averaging periods, the change in the traction performance level DEL_TE is evaluated. In a similar manner, with knowledge of the value of the torque maximizer state during the last averaging period, the change in allowable creep level of the axles DEL_CRP is obtained.

The torque maximizer state is computed in block 47 and is a function of the values of DEL_TE, DEL_CRP, the percentage of time that the system is operating in a wheelslip/wheelslide control mode (SLP_AVG), and the elapsed time since the system has been in the wheelslip/wheelslide control mode (NO_SLP_TIMER). SLP_AVG is the percent of time of the last averaging period that the adhesion control system is in either wheelslip or wheelslide control, as follows:

SLP_AVG=100 * [time in adhesion control]/averaging time period], evaluated every averaging period.

NO_SLP_TIMER is the timer which keeps track of the time since the adhesion control system was active. This variable is reset to zero whenever a wheelslip or wheelslide is active.

The following expressions define the torque maximizer state:

(1) If SLP_AVG is below a predetermined value, and the NO_SLP_TIMER has not expired, then the state of the torque maximizer will be set to maintain the present allowable creep level;

(2) If SLP_AVG is below the predetermined value, and the NO_SLP_TIMER has expired, then the state of the torque maximizer will be set to modulate the allowable creep level toward the stand-off creep limit;

(3) If SLP_AVG is equal to or exceeds the predetermined value, then the torque maximi2:er state will be set to a value that will decrease the allowable creep level as long as any of the following conditions are satisfied:

(a) DEL_TE>0 and DEL_CRP<0; or (b) DEL_TE<0 and DEL_CRP>0; or (c) DEL_TE=0 and DEL_CRP=0 and the previous value of the torque maximizer state was set to decrease the allowable creep level.

If neither (a), (b), nor (c) is satisfied, then the value of the torque maximizer will be set to increase the allowable creep level.

Limiting functions are provided to insure that the allowable creep speed remains within the region specified by the maximum and minimum allowable creep levels. For example, when the minimum allowable creep level boundary is encountered, the creep mode will be changed from a mode of decreasing the allowable creep level to a creep mode that increases the allowable creep level. Similarly, the converse will occur if the allowable creep level encounters the maximum allowable creep level.

Figure 4:
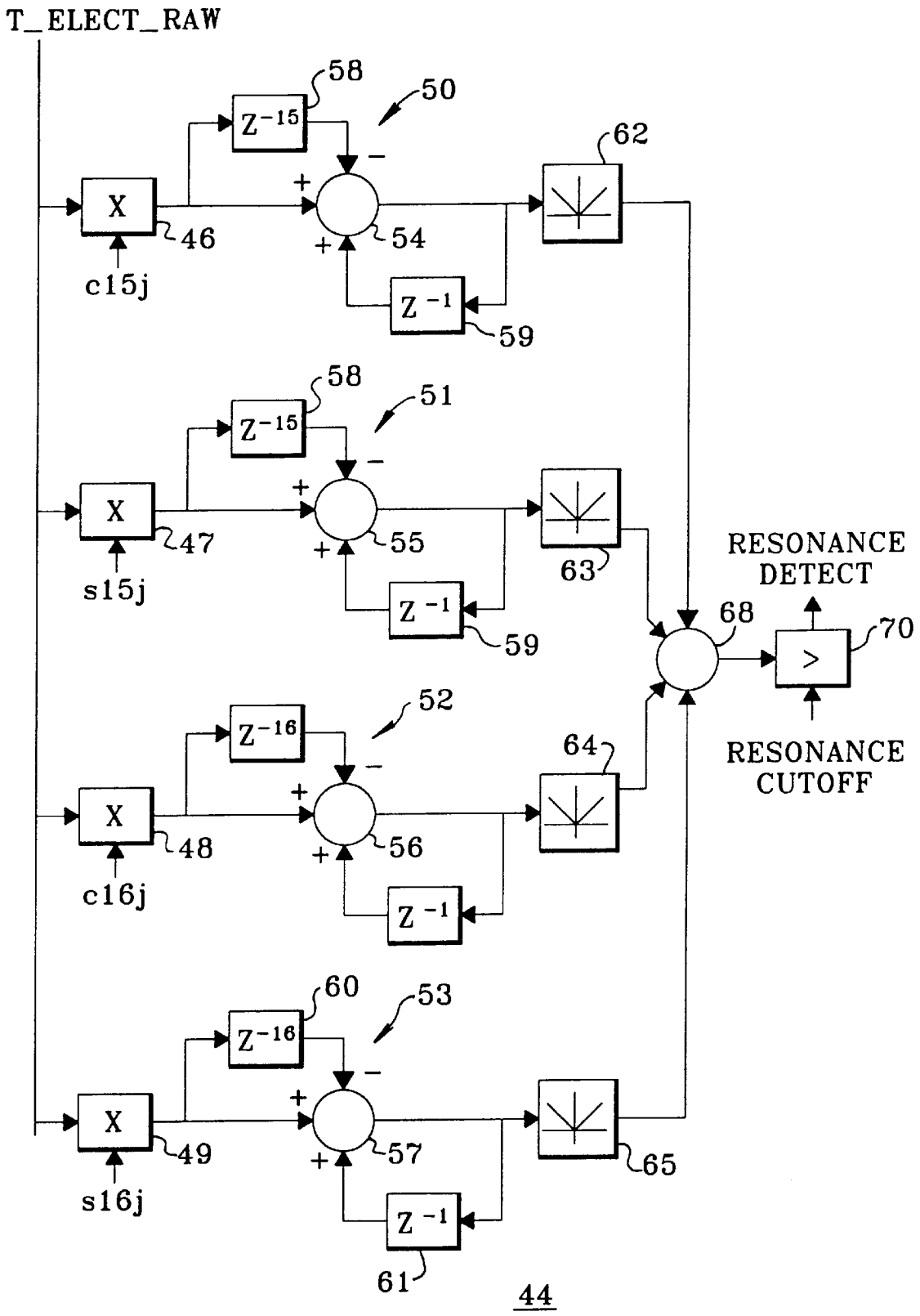
FIG. 4 is a block diagram illustrating one embodiment of a torsional vibration detector useful in the system of FIG. 2.

FIG. 4 illustrates an embodiment of torsional vibration detector 44. With reference to FIG. 1, controller 24 provides an estimate of the induction motor drive torque as a function of measured terminal voltages and currents for each traction motor and axle-wheel set. When the locomotive drive train operates in a region that excites the torsional natural frequency of the axle-wheel set, a disturbance in the torque feedback estimate can be detected. Such a disturbance will have a frequency component which is the same as the torsional natural frequency of the axle-wheel set. FIG. 4 illustrates a system for digital processing the estimated torque feedback in order to sense torsional vibrations in the locomotive drive axle. The digital processing system of FIG. 4 provides a measurement of the amplitude torque feedback disturbance that has the same frequency as the natural frequency of the drive axle.

As shown in FIG. 4, the estimated torque feedback T_ELEC_RAW from controller 24 (FIG. 1) is an input to the digital processing system of FIG. 4, i.e., torsional vibration detector 44. The estimated torque feedback T_ELEC_RAW is multiplied in multipliers 46–49 by four reference signals cl5j, sl5j, cl6j, and sl6j that are generated by software. Reference signals s15j and cl5j comprise sine and cosine functions, respectively, at a frequency band 1. Reference signals sl6j and cl6j comprise sine and cosine functions, respectively, at a frequency band 2. The two frequency bands are utilized to account for the mild variation in axle-wheel set natural frequency as the wheels wear. The products of multipliers 46–49, respectively, are provided to four separate rolling sum registers 50–53, respectively. In summers 54 and 55, the rolling sum registers 50 and 51 add the current product to and subtract the current product from the fifteen preceding iterations, functionally represented using blocks 58 ($Z^{-15}$) and blocks 59 ($Z^{-1}$). Similarly, in summers 56 and 57, the rolling sum registers 52 and 53 add the current product to and subtract the current product from the sixteen preceding iterations, functionally represented using blocks 60 ($Z^{-16}$) and blocks 61 ($Z^{-1}$). The output from each rolling sum register 50–53, respectively, is provided to an absolute value function block 62–65, respectively. (Alternatively, other options include taking the rms value instead of the absolute value.) The output from absolute value function blocks 62–65 are added together in a summer 68. The resulting sum, or filter output, is a measurement of the torsional vibration level. This filter output is provided to a resonance detector block 70 for comparison to a predetermined torsional vibration level RESONANCE CUTOFF. If this level is exceeded, then there is an excessive level of torsional vibration present in the drive train, and the output RESONANCE_DETECT of vibration detector is TRUE; otherwise, if the level is not exceeded, then the output RESONANCE_DETECT is FALSE.

Advantageously, the configuration of the torsional vibration detector of FIG. 4 requires only a minimum amount of inverter controller processing time to provide reliable torsional vibration detection. Although a two-band filter is illustrated and described herein, the torsional vibration digital processing scheme may utilize a bandpass filter having an arbitrary number of bands, n, which may, however, result in an increase in inverter processing time. Other alternative approaches include Butterworth or Chebyshev bandpass filters of different orders. In general, any digital processing scheme that can selectively pass signals of a given frequency range will work as part of the torsional vibration detection. As an alternative to the filtering schemes set forth herein, the torsional vibration detector could be configured to detect any ac component of the torque feedback by processing the difference between rms and average values of the estimated torque feedback or by looking at the standard deviation of torque. Alternatively, speed could be used instead of estimated torque.

Figure 5:
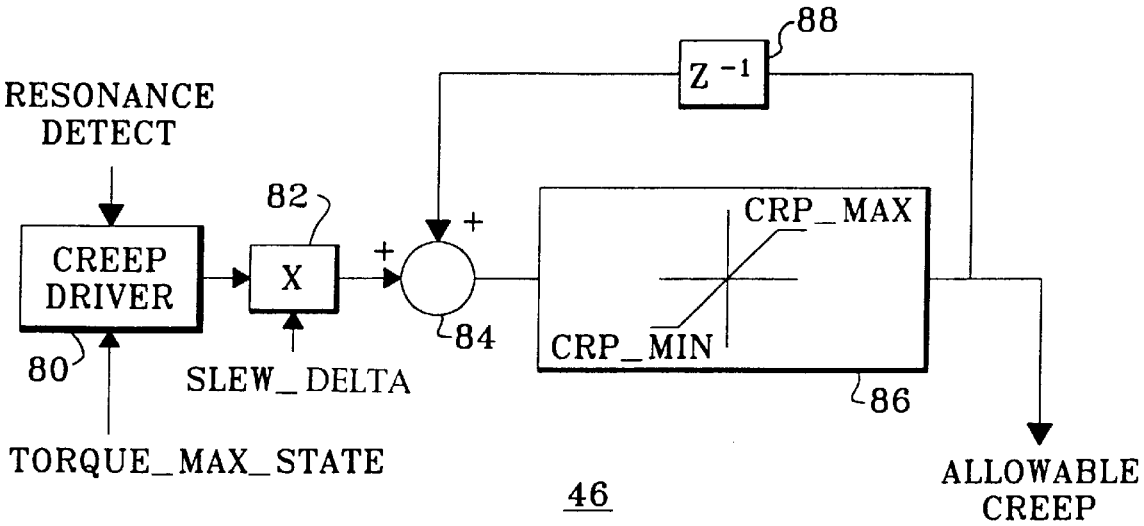
FIG. 5 is a block diagram illustrating one embodiment of a creep modulator useful in the system of FIG. 2.

FIG. 5 illustrates an embodiment of creep modulator 46 (FIG. 2). The function of the creep modulator is to modulate the allowable creep level for each axle between the maximum allowable creep level CRP_MAX and the minimum allowable creep level CRP_MIN. These maximum and minimum allowable creep levels are typically a function of speed or tractive effort. Additional constraints are applied to the allowable creep. These function to allow sufficient creep levels for starting the locomotive from zero speed and to provide a fixed allowable creep level when the axle is functioning as the reference speed mode.

The output from torque maximizer 42 (FIG. 3) TORQUE_MAX_STATE and the output from torsional vibration detector 44 (FIG. 4) RESONANCE_DETECT are provided to a creep driver 80 which develops a slew rate for modulating the allowable creep level. The slew rate from the creep driver is multiplied in a multiplier 82 by a predetermined nominal slew limit SLEW_DELTA. The product from multiplier 82 is provided to a summer 84 which adds the previous value of allowable creep via creep limit block 86 and $Z^{-1}$ block 88. Block 86 limits the allowable creep to values within the range set by the minimum and maximum limts, CRP_MIN and CRP_MAX. The output of creep limit block 86 is the present value of allowable creep.

The logic associated with the creep modulator is as follows:

(1) The presence of an undesirable level of torsional vibration, as indicated by RESONANCE_DETECT having a TRUE value, takes precedence over all other inputs to the creep driver and forces a reduction at a rate of several times the normal slew limit SLEW_DELTA.

(2) If a tolerable level of torsional vibration exists, as indicated by RESONANCE_DETECT having a FALSE value, operation of the creep modulator is controlled by output state of the torque maximizer TORQUE_MAX_STATE. When the torque maximizer is in control, the allowable level will be increased or decreased at the normal slew limit SLEW_DELTA.

Advantageously, through the use of the traction control system described hereinabove, traction performance is maximized while torsional vibration levels are minimized even when operating at maximum adhesion levels on each axle. As a further advantage, the traction control subsystem described hereinabove results in a reduction in operating noise levels due to wheel/rail squeal.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A traction control system for use in an electric traction motor propulsion system, comprising:

a torque maximizer for measuring performance level of the traction motor propulsion system and for determining a torque maximizer state for maximizing traction performance;

a torsional vibration detector for processing estimated torque feedback for detecting torsional vibration level; and a creep modulator for processing the torque maximizer state and torsional vibration level in order to control operating creep level.

2. The traction control system of claim 1 wherein the electric traction motor propulsion system comprises at least two traction motors, each having an axle-wheel set associated therewith, the torque maximizer measuring the performance level and maximizing traction performance of each axle-wheel set, the torsional vibration detector processing the estimated torque feedback for each traction motor, and the creep modulator controlling the operating creep level of each axle-wheel set.

3. The traction control system of claim 1 wherein the torque maximizer determines performance level from measurements of torque during averaging periods and has four possible torque maximizer states including (1) decreasing allowable creep level, (2) increasing allowable creep level, (3) maintaining present allowable creep level, and (3) modulating allowable creep level to a stand-off creep limit.

4. The traction control system of claim 2 wherein the torsional vibration detector comprises a digital signal processor for digitally processing the estimated torque feedback for each traction motor to provide a measurement of disturbance in the estimated torque feedback having a frequency component which is the same as the natural frequency of the axle-wheel set associated therewith.

5. The traction control system of claim 4 wherein the torsional vibration detector comprises an n-band bandpass filter.

6. The traction control system of claim 1 wherein the creep modulator comprises control logic for reducing the allowable creep level at a rate substantially more than a predetermined normal slew rate whenever the torsional vibration level exceeds a predetermined limit and for adjusting the allowable creep level at the normal slew rate depending on the torque maximizer state whenever the torsional vibration level is less than the predetermined limit.

7. A method for traction control in an electric traction motor propulsion system, comprising:

measuring performance level of the traction motor propulsion system and determining a torque maximizer state for maximizing traction performance;

detecting torsional vibration level by processing estimated torque feedback; and processing the torque maximizer state and the level of torsional vibration in order to control operating creep level.

8. The method of claim 7 wherein the electric traction motor propulsion system comprises at least two traction motors, each having an axle-wheel set associated therewith, the steps of measuring, detecting and processing being performed separately for each axle-wheel set.

9. The method of claim 7 wherein the step of measuring and determining comprises determining performance level from measurements of torques during averaging periods, there being four possible torque maximizer states including (1) decreasing allowable creep level, (2) increasing allowable creep level, (3) maintaining present allowable creep level, and (3) modulating allowable creep level to a stand-off creep limit.

10. The method of claim 8 wherein the step of detecting torsional vibration level comprises digitally processing the estimated torque feedback for each traction motor to provide a measurement of disturbance in the estimated torque feedback having a frequency component which is the same as the natural frequency of the axle-wheel set associated therewith.

11. The method of claim 10 wherein the step of detecting comprises an n-band bandpass filtering process.

12. The method of claim 7 wherein the step of processing the torque maximizer state and the torsional vibration level in order to control operating creep level comprises reducing the allowable creep level at a rate substantially more than a predetermined normal slew rate whenever the torsional vibration level exceeds a predetermined limit and for adjusting the allowable creep level at the normal slew rate depending on the torque maximizer state whenever the torsional vibration level is less than the predetermined limit.

* * * * *